US007617909B2

(12) United States Patent
Wolf et al.

(10) Patent No.: US 7,617,909 B2
(45) Date of Patent: Nov. 17, 2009

(54) MUFFLER

(75) Inventors: Thomas Wolf, Esslingen (DE); Arnulf Spieth, Hochdorf (DE); Remus Boriga, Wernau (DE)

(73) Assignee: J. Eberspaecher GmbH & Co. KG, Esslingen (DE)

( * ) Notice: Subject to any disclaimer, the term of this patent is extended or adjusted under 35 U.S.C. 154(b) by 96 days.

(21) Appl. No.: 11/731,939

(22) Filed: Apr. 2, 2007

(65) Prior Publication Data

US 2007/0227812 A1 Oct. 4, 2007

(30) Foreign Application Priority Data

Apr. 4, 2006 (DE) ..... 10 2006 016 095

(51) Int. Cl.

| | |
|---|---|
| ***F01N 1/02*** | (2006.01) |
| ***F01N 1/08*** | (2006.01) |
| ***F16L 59/21*** | (2006.01) |
| ***F16L 59/13*** | (2006.01) |
| *F01N 1/00* | (2006.01) |
| *F16L 59/16* | (2006.01) |

(52) U.S. Cl. ..... 181/269; 181/271; 285/49

(58) Field of Classification Search ..... 181/269, 181/271, 272, 281, 264, 209; 285/49, 53, 285/50, 48; 248/56, 68.1, 71

See application file for complete search history.

(56) References Cited

U.S. PATENT DOCUMENTS

| | | | | |
|---|---|---|---|---|
| 1,995,542 | A * | 3/1935 | Haviland | 285/322 |
| 4,233,726 | A | 11/1980 | Williams | |
| 4,291,905 | A * | 9/1981 | Schrock | 285/192 |
| 4,513,841 | A * | 4/1985 | Shimoji et al. | 181/252 |
| 5,477,015 | A * | 12/1995 | Preslicka et al. | 181/282 |
| 5,581,056 | A * | 12/1996 | Bellgardt et al. | 181/282 |
| 2005/0224283 | A1 * | 10/2005 | Yokoi et al. | 181/268 |
| 2006/0027388 | A1 * | 2/2006 | Collins | 174/65 R |
| 2006/0096805 | A1 * | 5/2006 | Staut | 181/271 |
| 2006/0251470 | A1 * | 11/2006 | Prause | 403/119 |
| 2007/0029135 | A1 * | 2/2007 | Ermer et al. | 181/269 |
| 2008/0115955 | A1 * | 5/2008 | Gorin et al. | 174/66 |
| 2008/0121460 | A1 * | 5/2008 | Hanitzsch et al. | 181/264 |

FOREIGN PATENT DOCUMENTS

| | | |
|---|---|---|
| DE | 2927758 | 4/1983 |
| DE | 3514475 | 10/1986 |
| DE | 4202079 | 7/1993 |

* cited by examiner

*Primary Examiner*—Edgardo San Martin
(74) *Attorney, Agent, or Firm*—Howard IP Law Group PC

(57) ABSTRACT

A connection between a plate and a pipe wherein the pipe passes through an opening in the plate, and wherein the plate has a spring-elastic tongue at the opening which is fixedly connected to the pipe.

16 Claims, 2 Drawing Sheets

MUFFLER

FIELD OF THE INVENTION

The present invention relates to a muffler for a line carrying gas and airborne sound, in particular for an exhaust system for an internal combustion engine.

BACKGROUND OF THE INVENTION

To reduce noise emissions by a gas-carrying line, e.g., an exhaust line for an internal combustion engine in which the gas flow also carries airborne sound, it is known that a muffler of the type defined above can be installed in this line. The muffler preferably has gas that is conveyed in the line flowing through it. At the same time as the gas, the airborne sound entrained by the gas also enters the muffler, where it is dampened by reflection, resonance and sound-absorbing materials, for example. The dampening of airborne sound is also of great interest with other gas-carrying lines, e.g., in a fresh air system of an internal combustion engine, so that the present invention should fundamentally not be limited to use in internal combustion engines.

If hot gas is carried in the line in which the muffler is arranged, e.g., in an exhaust line of an internal combustion engine, then thermal stresses necessarily occur and must be compensated via suitable countermeasures. A known countermeasure here is the arrangement of a sliding seat which allows an axial equalizing movement of two pipes inserted one into the other in the area of the sliding seat. In addition, it is customary to reinforce the housing of such a muffler with at least one inside plate through which the inside pipes must be guided, depending on the gas guidance in the interior of the muffler. The inside plates here also serve to secure the pipes in the housing. It is conventional to mount one pipe on a first inside plate in the vicinity of the sliding seat and the other pipe on a second inside plate or on a housing wall which is spaced a distance away from the first inside plate. However, the design of such a sliding seat and its connection to an inside plate of the housing are complicated and expensive.

DE 10 2004 054 441 describes a muffler in which two inside pipes are mounted on one and the same inside plate, and to this end, at least one spring-elastic first tongue attached to the first inside pipe and at least one spring-elastic second tongue attached to the other inside pipe are designed on this inside plate and the second tongue is movable with spring elasticity independently of the first tongue. Due to this design, the spring-elastic tongues can conform to the thermally induced changes in length of the inside pipes independently of one another without resulting in unacceptably high stresses inside the inside plate.

SUMMARY OF THE INVENTION

In one embodiment, a muffler having a connection of a pipe to an inside plate is provided and includes a spring-elastic tongue in the area of a through-opening in the inside plate. A first circumferential section of the through-opening has a radial play with the inside pipe which passes through the opening, while a free end of the spring-elastic tongue forms a second circumferential section of the opening and is fixedly connected to the inside pipe. The spring-elastic tongue allows thermal expansion and/or thermal movement between the inside pipe and the inside plate, whereas, at the same time, the fixed connection of the free end of the spring-elastic tongue ensures adequate fixation of the inside pipe to the inside plate. The inside pipe here is guided in one piece through the through-opening, so it does not have a sliding seat. Due to the fixed connection of the inside pipe to the spring-elastic tongue, fixation of the inside pipe to the inside plate is achieved; secondly, the spring-elastic tongue allows compensation of thermal expansion and thus a reduction in thermal loads.

In an exemplary embodiment of the present invention, the tongue is configured by cutting out or punching out the tongue on the inside plate. In this way, the first tongue can be manufactured especially easily and inexpensively and forms an integral component because of its being integrated into the inside plate. Thus, no additional installation expense is necessary, e.g., to attach tongues manufactured separately, for example, to the inside plate.

In another exemplary embodiment of the present invention, side walls of the tongue and/or walls of the inside plate adjacent thereto run in a plane arranged at a distance from the inside plate itself. With such a configuration, the thermal expansion of the gap between the inside plate and the tongue integrated therein is reduced, so that operation of the muffler greatly reduces this gap width. The inside plate separates an expansion chamber from an absorption chamber filled with free-flowing absorbent material. Due to a reduction in the gap width between the spring-elastic tongue and the inside plate it is thus possible to prevent free-flowing absorbent material from escaping and thereby having a negative effect on the dampening performance of the muffler.

One slot end between the tongue and the inside plate is free of notching. This may be accomplished for example by rounding out the slot end so that the risk of cracking of the slot end can be reduced. Of course in addition to rounding of the slot end, other suitable geometries are also conceivable, preventing or at least reducing the cracking of the slot end into the inside plate.

It is self-evident that the features mentioned above and those yet to be explained below may be used not only in the particular combination given but also in other combinations or alone without going beyond the scope of the present invention.

An exemplary embodiment of the invention is depicted in the drawings and explained in greater detail in the following description, where the same reference numerals are used to refer to the same or similar or functionally identical parts.

BRIEF DESCRIPTION OF THE DRAWINGS

In schematic diagrams

DETAILED DESCRIPTION OF THE INVENTION

Figure 1:
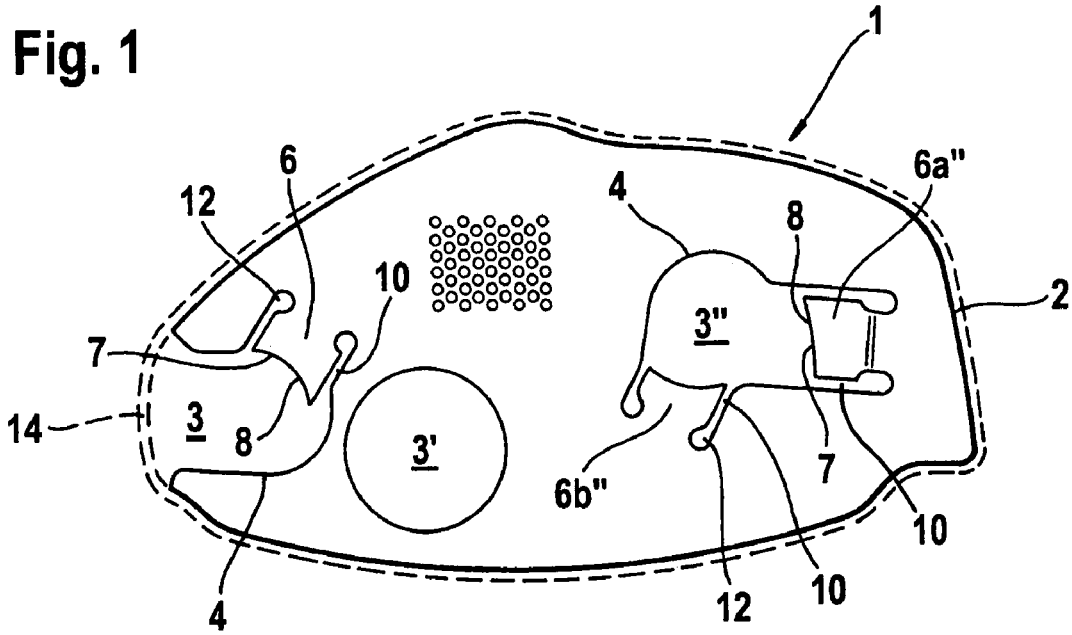
FIG. 1 shows a frontal view of an inside plate according to an exemplary embodiment of the invention with spring-elastic tongues in the area through-openings.

FIG. 1 shows an inside plate 1, which is usually arranged as reinforcement in a muffler (not shown). The inside plate 1 may be arranged in an exhaust system of an internal combustion engine, and may be connected to a housing 14, indicated only with an interrupted line, along its circumferential edge 2. As also shown in FIG. 1, the inside plate 1 has three (3) through-openings 3, 3', 3" through which lines carrying gas and airborne sound pass when the muffler is installed (see FIG. 3). According to an embodiment of the invention, a first circumferential section 4 of the opening 3 and/or 3" has a radial play with an inside pipe 5 (see FIG. 3). In addition, in the area of the inside pipe 5, the inside plate 1 has at least one spring-elastic tongue 6, which forms a second circumferential section 7 of the opening 3, 3" at its free end 8 and is fixedly connected to the inside pipe 5. According to FIGS. 1 through 3, the inside plate 1 has only one spring-elastic tongue 6 in the area of the through-opening 3, while it has two spring-elastic tongues 6*a*" and 6*b*" in the area of the through-opening 3".

The aforementioned spring-elastic tongues 6 and/or 6*a*" and 6*b*" may be formed by free cutting or free punching on the inside plate 1, for example, and therefore produced easily and inexpensively. Furthermore, in this embodiment they form an integral component of the inside plate 1, which makes subsequent assembly of a separately formed tongue, for example, unnecessary. On its fixed end, i.e., in the area of the connection to the inside plate 1, the spring-elastic tongue 6 runs essentially parallel to the inside plate 1 so that a spring action of the tongue 6 is possible mainly in the direction normal to the inside plate 1.

On their free ends 8 the tongues 6, 6*a*" and 6*b*" shown here have a second plane 9 which is arranged at an angle (see FIG. 2) by means of which the spring-elastic tongues 6, 6*a*", 6" are fixedly connected to the respective inside pipes 5. The free end 8 of the tongue 6 and/or the second plane 9 arranged thereon may be connected to the inside pipe 5 by joining them by welding or gluing or soldering, for example. The second plane 9 is angled with respect to the first plane in which the inside plate 1 extends.

The inside plate 1 may be adapted, for example, as a partition between two chambers, whereby it is conceivable that one of these chambers is configured as an absorption chamber and the other is configured as an expansion chamber. Between the spring-elastic tongue 6 and the inside plate 1, slots 10 are arranged in FIGS. 1 through 4, allowing a resilient movement of the free end 8 of the tongue 6 and at the same time being dimensioned such that in the case of an inside plate 1 configured as a partition between an absorption chamber and an expansion chamber, blowout of absorbent material out of the absorption chamber is prevented or at least reduced. A side wall 11 of the section of the inside plate 1 adjacent to the tongue 6 and/or to the slot 10 may run in a plane arranged at a distance from the inside plate 1. Such a plane of the wall 11 at a distance from the plane of the inside plate 1 is shown in FIG. 4, for example. Of course a side wall 11' of the tongue 6 may also run in a plane arranged at a distance from the inside plate 1. These walls 11 and/or 11' arranged in this way have the effect that the slots 10 between the tongue 6 and the inside plate 1 preferably close or at least constrict during operation of the muffler due to the thermal expansion.

As can also be seen from FIGS. 1 through 4, a slot end 12 between the tongue 6 and the inside plate 1 is adapted without notching. Such a notch-free design may be accomplished, for example, by rounding the slot end 12. In addition, other embodiments of the slot end 12 that at least inhibit notching are also conceivable.

Figure 2:
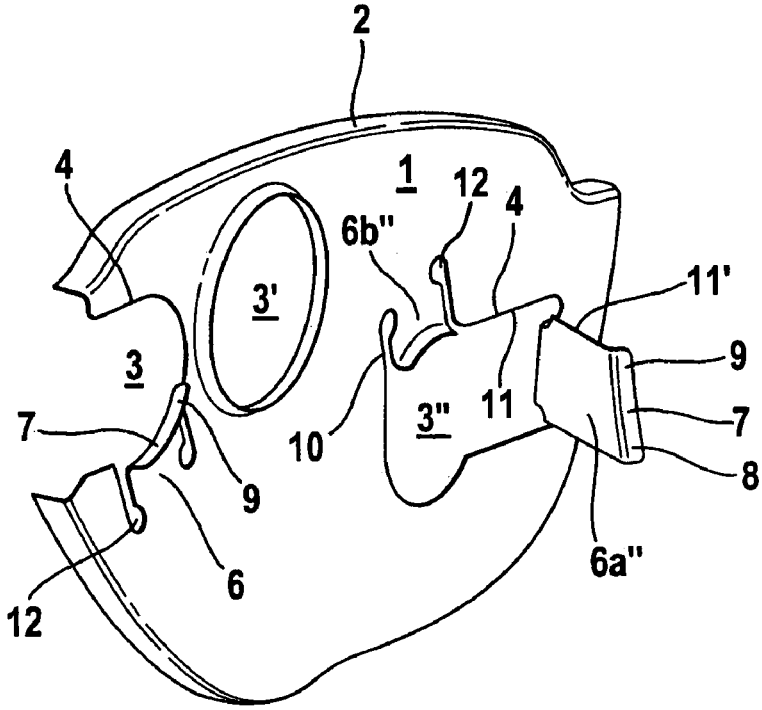
FIG. 2 shows a perspective view of the inside plate.
Figure 3:
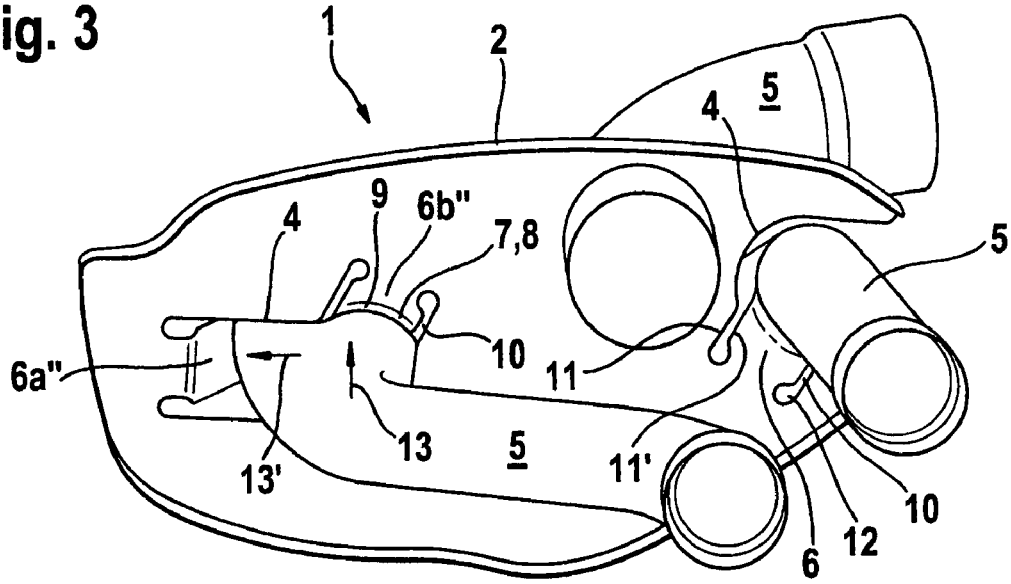
FIG. 3 shows an inside plate with inside pipes passing through it.
Figure 4:
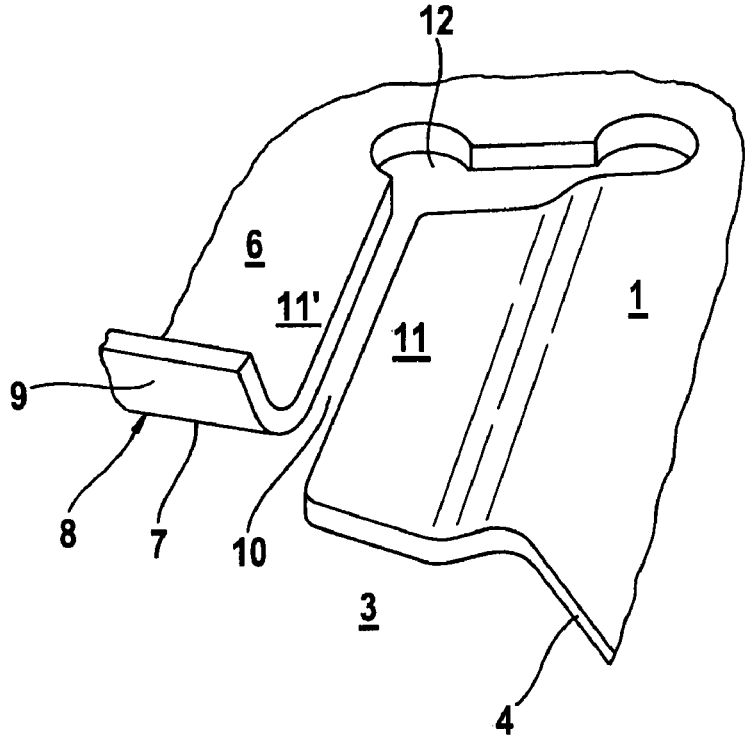
FIG. 4 shows a detailed view of a wall of a spring-elastic tongue formed on the inside plate.

As shown in FIGS. 1 through 3, the through-opening 3, 3' and 3" need not be circular but instead may have an inside diameter adapted to the particular inside pipe 5 to be passed through it. Likewise, either one or more spring-elastic tongues 6 may be provided per opening 3. In addition, a control of the thermal expansion that can be absorbed by the tongue 6 configured to be elastic can also be influenced by selecting a bend angle of the tongue 6 to the respective inside pipe 5 accordingly. This is illustrated on the basis of FIG. 3, for example, in which the tongue 6*a*" has a definitely larger bend angle than the tongue 6 and therefore is capable of absorbing thermal expansion stresses not only in the direction 13 but also in the direction 13'.

Due to the inventive connection between the inside plate 1 and at least one inside pipe 5, it is thus possible to secure the inside pipe 5 fixedly on the one hand, namely via the free end 8 of the tongue 6 on the inside plate 1, and to be able to absorb with no problem an expansion occurring due to temperature effects without resulting in critical stress states that under some circumstances cause damage to the inside plate 1 and/or the inside pipe 5. The inside pipe 5 which is to be passed through is configured in one piece and does not require a sliding seat or the like owing to the spring-elastic tongue 6. The present invention is of course not limited to mufflers and/or inside plates 1 and inside pipes 5 of mufflers but instead includes all such through-openings of pipes and/or lines through walls and/or floors designed in this way.

The invention claimed is:

1. A muffler for a line carrying gas and airborne sound, for an exhaust system of an internal combustion engine, said muffler comprising:

a housing in which an inside pipe is arranged for carrying gas in the interior of the housing; and an inside plate having an opening, said inside plate positioned in said housing and reinforcing said housing;

wherein only the inside pipe, and no other pipe, penetrates through said opening in said inside plate, wherein a first circumferential section of said opening has a radial play with respect to said inside pipe, wherein a first spring-elastic tongue is defined in said opening in the area of the inside pipe, said first spring-elastic tongue forming on its free end a second circumferential section of the opening and being fixedly connected to said inside pipe, and wherein the inside pipe is the only pipe connected to the inside plate at said opening.

2. The muffler according to claim 1, wherein said first spring-elastic tongue is formed by free culling or free punching on said inside plate.

3. The muffler according to claim 1, wherein said first spring-elastic tongue on its fixed end runs essentially parallel to said inside plate.

4. The muffler according to claim 1, wherein at its free end, said first tongue is attached to said inside pipe in a second plane which is angled to the plane in which the inside plate extends.

5. The muffler according to claim 1, wherein at its free end, said first tongue is attached to said inside pipe in a second plane which is at a distance from the plane in which the inside plate extends.

6. The muffler according to claim 1, wherein said inside plate separates at least a first and a second chamber of said muffler from one another.

7. The muffler according to claim 1, wherein said inside plate separates at least one absorption chamber and one expansion chamber from one another in said muffler.

8. The muffler according to claim 1, wherein side walls of the first tongue run in a plane arranged at a distance from said inside plate.

9. The muffler according to claim 1, wherein walls of said first tongue run in a plane arranged at a distance from said inside plate.

10. The muffler according to claim 1, wherein slots disposed between said first tongue and said inside plate are adapted to reduce leakage of absorbent material from the absorption chamber.

11. The muffler according to claim 1, wherein said first tongue, said inside plate and the inside pipe are arranged so that slots formed between the first tongue and the inside plate taper due to thermal expansion during operation of the muffler.

12. The muffler according to claim 1, wherein one slot end between the first tongue and the inside plate is free of notching.

13. The muffler according to claim 1, wherein said free end of said first tongue is welded to the inside pipe.

14. The muffler according to claim 13, wherein a bend angle between said first tongue and said inside plate is selected according to a main direction of absorption of thermal stresses.

15. The muffler according to claim 1, wherein a second spring-elastic tongue is defined in said opening in said inside plate, wherein said first and second spring-elastic tongues are arranged at the inside pipe with a distance between each other in a longitudinal direction of said inside pipe.

16. The muffler according to claim 1, wherein said inside plate further comprises a perforated area.

* * * * *